US010035157B2

(12) United States Patent
Naito et al.

(10) Patent No.: US 10,035,157 B2
(45) Date of Patent: Jul. 31, 2018

(54) LIQUID EJECTING APPARATUS

(71) Applicant: SEIKO EPSON CORPORATION, Tokyo (JP)

(72) Inventors: Naoki Naito, Nagano (JP); Keiichiro Yoshino, Nagano (JP); Ryoji Fujimori, Nagano (JP); Takeshi Iwamuro, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 14/670,891

(22) Filed: Mar. 27, 2015

(65) Prior Publication Data

US 2015/0273501 A1 Oct. 1, 2015

(30) Foreign Application Priority Data

Mar. 31, 2014 (JP) ..... 2014-071234

(51) Int. Cl.
*B41J 2/175* (2006.01)
*B05B 9/08* (2006.01)

(52) U.S. Cl.
CPC ..... *B05B 9/0816* (2013.01); *B41J 2/175* (2013.01); *B41J 2/1752* (2013.01); *B41J 2/17513* (2013.01); *B41J 2/17523* (2013.01); *B41J 2/17553* (2013.01); *B41J 2/17556* (2013.01)

(58) Field of Classification Search
USPC ..... 347/85, 86, 87
See application file for complete search history.

(56) References Cited

U.S. PATENT DOCUMENTS 4,551,734 A 11/1985 Causley et al.
4,558,326 A * 12/1985 Kimura ..... B41J 2/16526 347/26
6,113,228 A 9/2000 Pawlowski, Jr. et al.
6,786,584 B2 * 9/2004 Kaga ..... B41J 2/1721 347/86
2011/0254905 A1 * 10/2011 Hayashi ..... B41J 2/175 347/86
2013/0187985 A1 7/2013 Katoh et al.
2013/0201262 A1 * 8/2013 Iwamura ..... B41J 2/17503 347/86
2015/0273842 A1 10/2015 Aoki et al.

FOREIGN PATENT DOCUMENTS

CN 103213400 A 7/2013
CN 104943389 A 9/2015
JP 2002-512572 A 4/2002

* cited by examiner

*Primary Examiner* — Lam Nguyen

(57) ABSTRACT

A liquid ejecting apparatus includes a liquid container containing section, and a pressurizing section that pressurizes inside of the liquid container containing section. The liquid container containing section has a casing that contains a liquid container, a mounting member that is mounted with the liquid container, and a cover that covers an opening that is formed in the casing, the mounting member is arranged inside the casing on the opening side, the cover is arranged outside the casing on the opening side, and the mounting member is fixed to the cover.

12 Claims, 9 Drawing Sheets

LIQUID EJECTING APPARATUS

CROSS-REFERENCE TO RELATED APPLICATIONS

This application claims priority to Japanese Patent Application No. 2014-071234 filed on Mar. 31, 2014. The entire disclosure of Japanese Patent Application No. 2014-071234 is hereby incorporated herein by reference.

BACKGROUND

Technical Field

The present invention generally relates to a liquid ejecting apparatus which contains a liquid container.

Related Art

In the prior art, there is a liquid ejecting apparatus which is provided with a liquid ejecting section which ejects liquid such as ink where an ink container is contained in an inner section of a pressure tank. Japanese Unexamined Patent Application Publication (Translation of PCT Application) No. 2002-512572 (PTL 1) discloses an example of this type of ink container and pressure tank. In PTL 1, a cover (a chassis 1120) is fixed to an opening in the pressure tank (a pressure container 1102). A pressurizing hole (an air inlet 1108) into which is fed pressurized air, an ink supply section (an ink outlet 1110), a connection terminal (memory element contact points 1172A and 1172B), and the like are provided in the cover. The ink container (a foldable tank 114) which is arranged inside the pressure tank is mounted in a connecting section (an attachment surface 1122) which is provided on the rear side of the cover. The cover is fixed to an edge of the opening of the pressure tank using a crimp ring 1280.

SUMMARY

In the manner described above, the ink supply section, the pressurizing hole, the connection terminal which connects with a circuit board in the ink container, and the like are provided in the cover of the pressure tank which contains the ink container. On the other hand, apparatus side components which are connected to the ink supply section, the pressurizing hole, the connection terminal, and the like are provided in the liquid ejecting apparatus. For example, a supply tube which is connected to the ink supply section in the pressure tank, a pressurizing tube which feeds pressurized air into the pressurizing hole in the pressure tank, a connector which connects a control section of the liquid ejecting apparatus and a connection terminal in the pressure tank, and the like are provided. Here, as shown in PTL 1, there is a concern that the cover may positionally deviate due to rotation in a case where the circular cover is mounted in a circular opening. In particular, there is a concern in the case of the cover of the pressure tank that the cover may become loose due to pressure in a structure for fixing using the crimp ring 1280 from the outside of the tank as in PTL 1. There is a concern that, when the cover positionally deviates due to becoming loose, there may be defects such as ink leaking from the ink supply section, air leaking from the pressurizing hole, ink flowing into the pressurizing hole, and terminal connection faults.

Considering these points, the problem of the present invention is to suppress defects that are caused by positional deviation of a cover that seals an opening that is formed in a pressure container that contains a liquid container.

In order to solve the problem described above, a liquid ejecting apparatus of the present invention is provided with a liquid container containing section, and a pressurizing section that pressurizes inside of the liquid container containing section, wherein the liquid container containing section has a casing that contains a liquid container, a mounting member that is mounted with the liquid container, and a cover that covers an opening that is formed in the casing, the mounting member is arranged inside the casing on the opening side, the cover is arranged outside the casing on the opening side, and the mounting member is fixed to the cover.

According to the present invention, the cover, that covers the opening in the casing that contains the liquid container, is fixed to the mounting member that is arranged inside the casing on the opening side. By doing this, movement of the cover to a side that is away from the opening is impeded by the mounting member. Accordingly, the concern that the cover may be loosened is reduced and positional deviation of the cover is suppressed even in a case where the inside of the casing is pressurized. As such, it is possible to suppress defects that are caused by positional deviation of the cover (for example, connection faults at an ink supply section, a pressurizing hole, a connection terminal, and the like that are provided in the cover).

In the present invention, it is desirable if the mounting member has a mounting member positional alignment section that positionally aligns the cover, the cover has a cover engaging section that is positionally aligned by the mounting member, and the cover engaging section is positionally aligned by engaging with the mounting member positional alignment section. By doing this, it is possible to positionally align the cover by engaging with the mounting member. Accordingly, it is possible to suppress positional deviation of the cover with regard to the mounting member.

In the present invention, it is desirable if the cover is rotatably provided with regard to the opening and the cover engaging section is formed at a position that is closer to an outer edge of the cover than a center of rotation of the cover. In this manner, when the cover engaging section is provided at a position that is separated from the center of rotation, resistance from the cover engaging section when the cover moves to rotate is large compared to a case where the cover engaging section is provided at a position that is closer to the center of rotation. Accordingly, it is possible to strongly suppress positional deviation of the cover and the mounting member.

In the present invention, it is desirable if the cover engaging section is provided at two locations that are point symmetrical with the center of rotation of the cover as a reference. By doing this, the resistance is doubled since the resistance that opposes the rotation of the cover acts at both sides that interpose the center of rotation. Accordingly, it is possible to more strongly suppress positional deviation of the cover and the mounting member.

In the present invention, it is desirable if a liquid ejecting section, a connection terminal that connects with a circuit board that is provided in the liquid container, a liquid supply section that supplies liquid from the liquid container to the liquid ejecting section, and a pressurizing hole into which a pressurized fluid flows from the pressurizing section are further provided, the pressurizing hole is formed at a position that is closer to an outer edge of the cover than a center of rotation of the cover, the connection terminal and the liquid supply section are arranged at a position that is closer to the center of rotation of the cover than the pressurizing hole, and the liquid supply section is arranged at a position that is closer to the center of rotation of the cover than the connection terminal. By doing this, it is possible to arrange the liquid supply section and the connection terminal at a position where the amount of positional deviation is small in a case where the cover is rotated. Accordingly, it is possible to suppress leaking of liquids and terminal contact faults. In addition, it is possible to supply liquid from the center of the liquid container in the width direction since the liquid supply section is even closer to the center of rotation than the connection terminal. Accordingly, in a case where a liquid container in the shape of a bag is used, it is possible to increase the capacity of the liquid container. Furthermore, even if it is assumed that liquid leaks from the liquid supply section, there is little concern that liquid that leaks flows into the pressurizing hole since the pressurizing hole is separated from the liquid supply section.

In the present invention, it is desirable if a diameter of a liquid flow path that is provided in the liquid supply section is larger than a diameter of the pressurizing hole. In this manner, it is possible to increase the liquid flow amount in a case where the diameter of the liquid flow path is large since the loss of pressure is small. Accordingly, it is possible to stably supply liquid to the liquid ejecting section where the amount of liquid discharge is large. In addition, in a case where the pressurizing hole is small, it is possible to reduce the concern that pressurized fluid may leak from the pressurizing hole.

In the present invention, it is desirable if the cover further has a fixing hole that fixes the cover to the mounting member, and the fixing hole is arranged at a position that is closer to a center of rotation of the cover than a cover engaging section. By doing this, the amount of positional deviation of the fixing hole is small when the cover is positionally aligned with the mounting member using the cover engaging section. Accordingly, it is possible to precisely fix the cover to the mounting member and assembly precision is improved.

According to the present invention, it is possible to suppress positional deviation of a cover that covers an opening, that is provided in a pressurized container that contains a liquid container, and it is possible to prevent defects that are caused by positional deviation of the cover.

BRIEF DESCRIPTION OF THE DRAWINGS

Referring now to the attached drawings which form a part of this original disclosure.

DETAILED DESCRIPTION OF EMBODIMENTS

An embodiment of a liquid ejecting apparatus and a liquid container which is attached to and detached from a liquid container containing section in the liquid ejecting apparatus where the present invention is applied will be described below with reference to the drawings. In the following embodiment, the present invention is applied to an ink jet printer and a liquid container which is attached to and detached from a liquid container containing section in the ink jet printer, but it is possible to apply the present invention to a liquid ejecting apparatus which ejects liquids other than ink and a liquid container in the liquid ejecting apparatus.

(Overall Configuration)

Figure 1A:
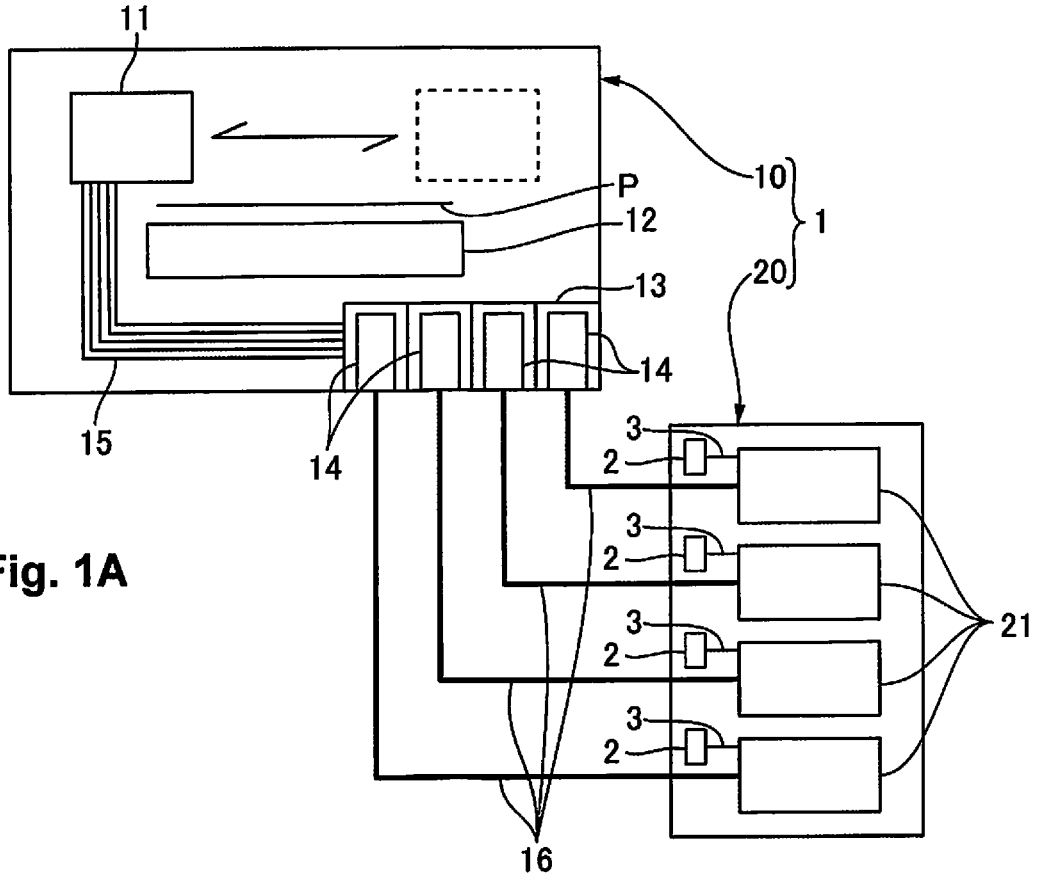
FIGS. 1A and 1B are explanatory diagrams schematically illustrating main sections of an ink jet printer where the present invention is applied.
Figure 1B:
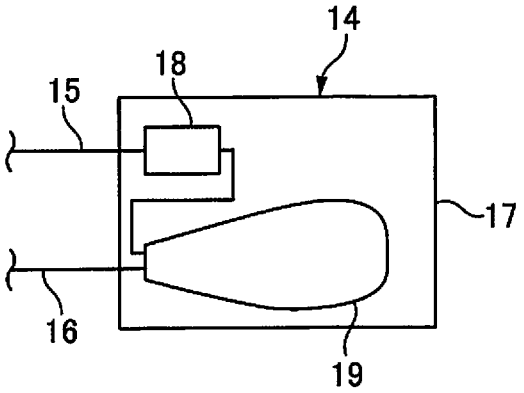

FIGS. 1A and 1B are explanatory diagrams schematically illustrating main sections of a printer where the present invention is applied, FIG. 1A illustrates the overall configuration and FIG. 1B illustrates the configuration of an intermediate tank. A printer 1 (a liquid ejecting apparatus) is an ink jet printer and is provided with a printer body section 10 and an ink containing unit 20. The printer body section 10 performs printing on a printing medium P using ink which is an example of a liquid. The ink containing unit 20 retains ink which is supplied to the printer body section 10.

An ink jet head 11 (a liquid ejecting section), a platen unit 12, a medium transport mechanism (which is omitted from the drawings), a head moving mechanism (which is omitted from the drawings), and the like are provided at an inner section of the printer body section 10. The printing medium P is transported along a platen surface by the medium transport mechanism which is provided with a paper feeding roller, a paper feeding motor, and the like. The ink jet head 11 is moved back and forth by the head moving mechanism in a direction which cuts across the platen surface. The head moving mechanism is provided with a carriage which is mounted with the ink jet head 11, a carriage guide shaft which extends in a direction which cuts across the platen surface, a carriage moving mechanism which moves the carriage back and forth along the carriage guide shaft, a carriage motor, and the like. When the printing medium P passes over the platen surface, printing is performed using the ink jet head 11.

In addition, the printer body section 10 is provided with a cartridge mounting section 13. One each of intermediate tanks 14 which contain ink of each color of cyan ink C, magenta ink M, yellow ink Y, and black ink Bk are mounted in the cartridge mounting section 13. The ink jet head 11 and the intermediate tanks 14 are connected by supply tubes 15 which are flexible. On the other hand, the ink containing unit 20 is provided with the same number of main tanks 21 as the number of the intermediate tanks 14 (four in the present embodiment). The four main tanks 21 are supported by a support frame of the ink containing unit 20. The intermediate tanks 14 and the main tanks 21 are connected by supply tubes 16 which are flexible. Here, the number of the intermediate tanks 14 and the main tanks 21 may be a number other than four, and the types of ink which are contained may be different to the four inks described above. In addition, a pressurizing section 2 is provided in each of the main tanks 21 inside the ink containing unit 20. The main tanks 21 are pressurized using pressurized air which is fed from the pressurizing sections 2. The pressurizing sections 2 and the main tanks 21 are connected using pressurizing tubes 3.

As shown in FIG. 1B, the intermediate tanks 14 are provided with cartridge type casings 17, and filters 18 and ink containers 19 which are arranged at an inner section of the casings 17. The ink containers 19 are tube containers which are flexible and, for example, blow bottles which are manufactured from resin are used. When the intermediate tanks 14 are mounted in cartridge mounting section 13, ink supply needles are inserted into connection ports which are provided in the casings 17. Due to this, the ink containers 19 and the supply tubes 15 are connected via filters 18, and the ink containers 19 and the supply tubes 16 are connected. Accordingly, it is possible for ink which is retained in the main tanks 21 to be supplied to the intermediate tanks 14, temporarily retained, and supplied from the intermediate tanks 14 to the ink jet head 11.

(Main Tanks)

Figure 2:
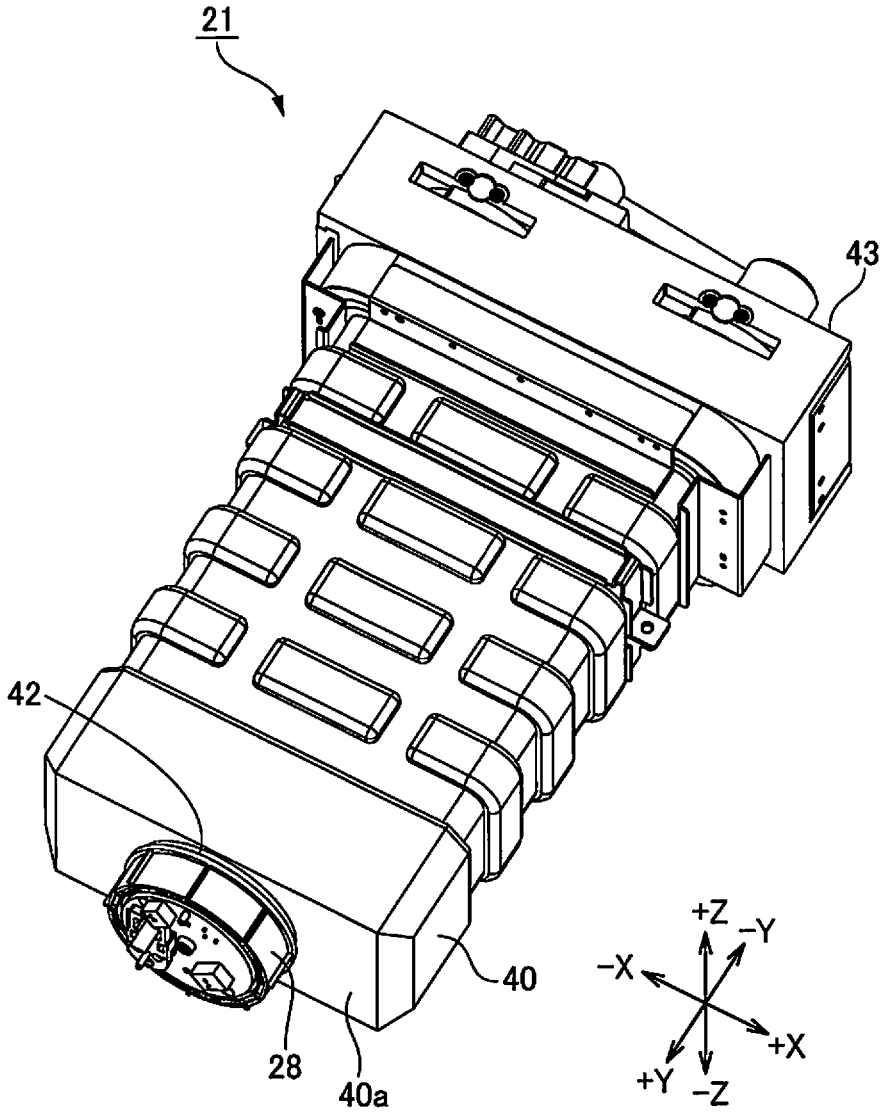
FIG. 2 is a perspective diagram of the outer appearance of a main tank.
Figure 3:
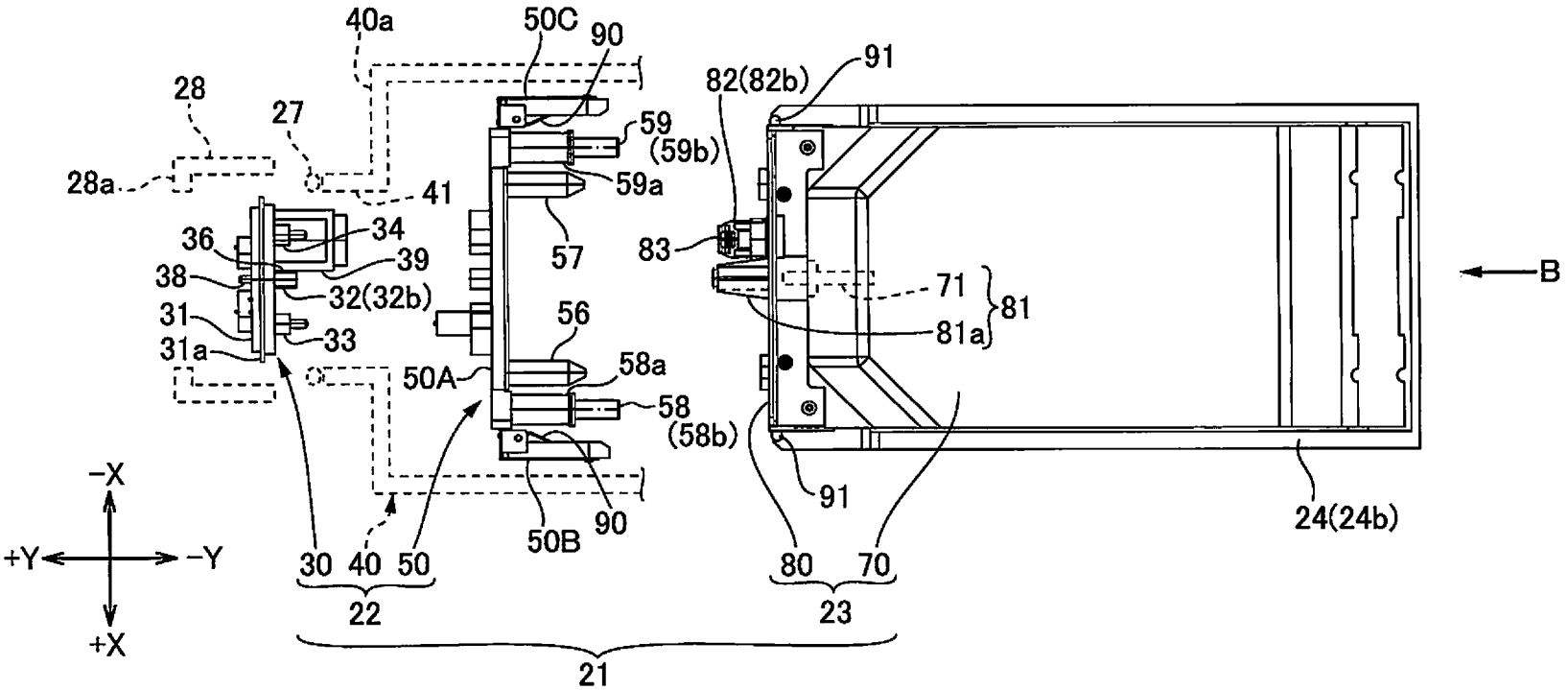
FIG. 3 is an exploded planar diagram of a main tank.
Figure 4:
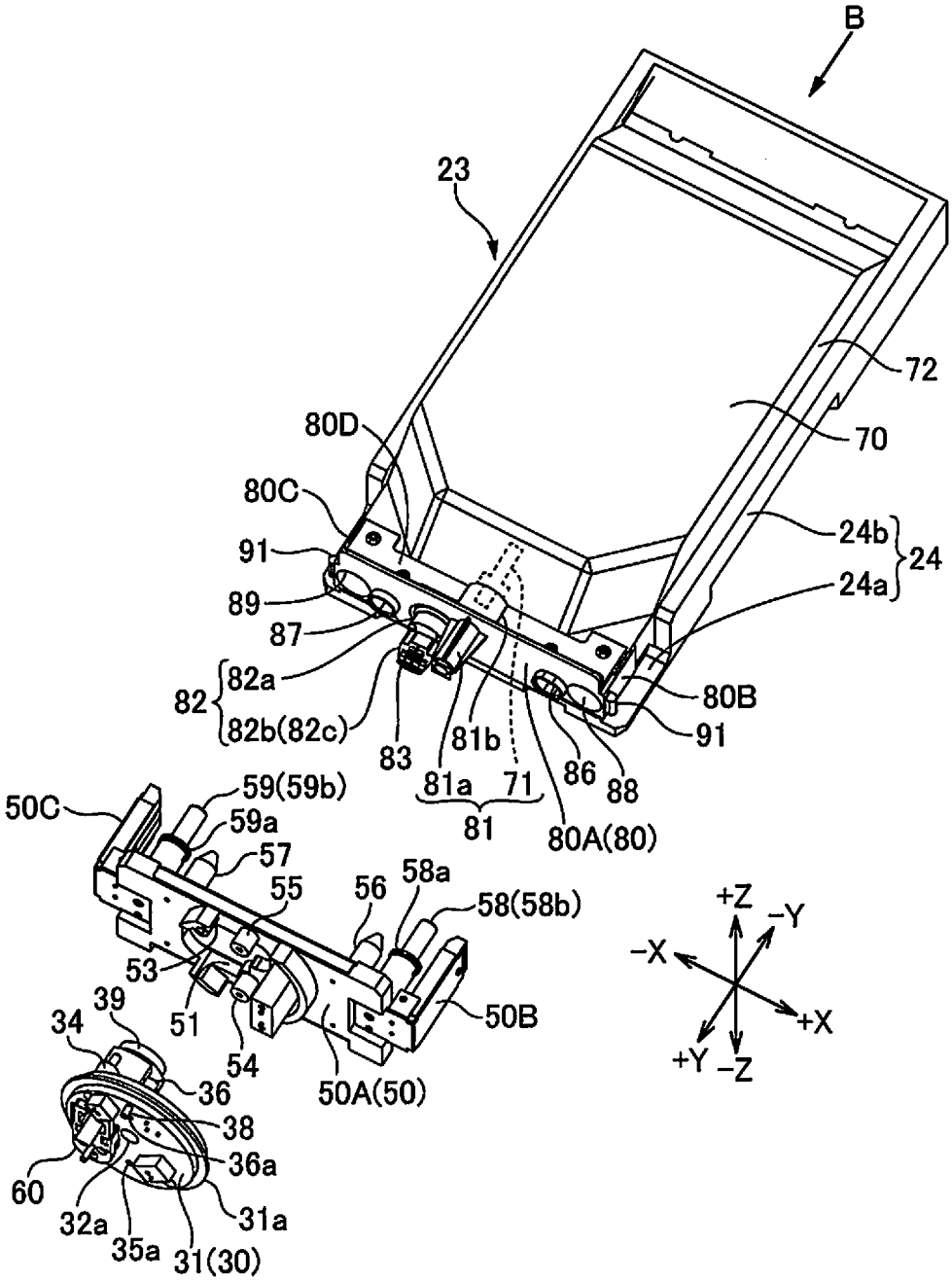
FIG. 4 is an exploded perspective diagram of a main tank.

FIG. 2 is a perspective diagram of the outer appearance of the main tank 21, and FIG. 3 is an exploded planar diagram of the main tank 21. In addition, FIG. 4 is an exploded perspective diagram of the main tank 21 and illustrates a state where a blow tank is omitted. The main tank 21 is provided with an ink container containing section 22 (a liquid container containing section) which is a sealed container, an ink container 23 (a liquid container) which is mounted in an inner section of the ink container containing section 22 so as to be able to be attached and detached, and a tray 24 onto which the ink container 23 is loaded. The ink container containing section 22 is provided with a cover 30 with a circular shape, a blow tank 40 (a casing), and a mounting member 50. The mounting member 50 is arranged in an inner section of the blow tank 40 on the rear side of the cover 30. In the present description below, a container width direction X, a container forward and backward direction Y, and a container up and down direction Z are three directions which are orthogonal to each other. In addition, one side in the container width direction X is a +X direction and the other side in the container width direction X is a −X direction, one side in the container forward and backward direction Y is a +Y direction and the other side in the container forward and backward direction Y is a −Y direction, and one side in the container up and down direction Z is a +Z direction and the other side in the container up and down direction Z is a −Z direction.

(Structure for Opening and Closing Ink Container Containing Section)

The blow tank 40 is a container which is manufactured from resin with a substantially rectangular shape which is long in the container forward and backward direction Y. A circular opening 41 (refer to FIG. 3), which passes through a container front surface section 40*a* which is positioned at an end section on the +Y direction side, is formed in the blow tank 40. A cylindrical section 42 which protrudes to the +Y direction side is formed at an opening edge of the circular opening 41. The cover 30 is mounted at a tip end of the cylindrical section 42 and covers and blocks off the circular opening 41 in an air-tight state. The cover 30 is provided with a cover body section 31 with a substantially circular plate shape, and a flange section 31*a* overhangs with an annular shape from the outer circumferential end surface of the cover body section 31. An O-ring 27 (refer to FIG. 3) is arranged between the flange section 31*a* and the tip end surface of the cylindrical section 42. In addition, an outer side ring 28 (refer to FIG. 2 and FIG. 3) is mounted at the outer circumferential side of the cylindrical section 42 and the cover 30. The outer circumferential surface of the cylindrical section 42 and the inner circumferential surface of the outer side ring 28 oppose each other in the radial direction, a male screw section is formed in one out of the outer circumferential surface of the cylindrical section 42 and the inner circumferential surface of the outer side ring 28, and a female screw section is formed in the other out of the outer circumferential surface of the cylindrical section 42 and the inner circumferential surface of the outer side ring 28. The outer side ring 28 is mounted such that the screw sections mesh with each other. An annular section 28*a* which overhangs on the inner circumferential side is formed on an end section of the outer side ring 28 on the +Y direction side. When the outer side ring 28 is fastened, the annular section 28*a* presses on the flange section 31*a* from the +Y direction side. Due to this, a gap between the flange 31*a* and the cylindrical section 42 is sealed by the O-ring 27.

On the other hand, a rear side opening (which is omitted from the drawings) which is an opening in the −Y direction is formed in the blow tank 40 at an end section which is at the opposite side to the circular opening 41, and an opening and closing door 43 which opens and closes the rear side opening is attached. The opening and closing door 43 opens and closes by swinging with one end side in the container width direction X as the center. The ink container 23 and the tray 24 move in and out from the rear side opening to the inside of the blow tank 40 due to the opening and closing door 43 being opened. When the opening and closing door 43 is closed, the rear side opening is blocked off in the air-tight state.

(Liquid Supply Section)

Figure 5B:
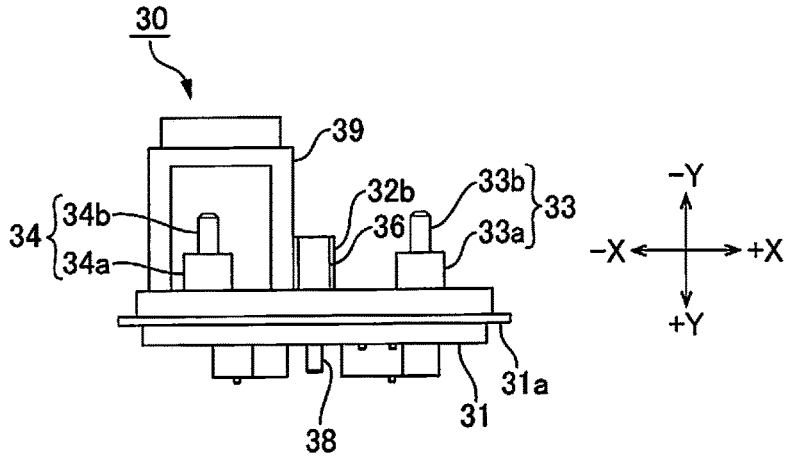
FIGS. 5B and 5C are side surface diagrams of a cover.
Figure 5A:
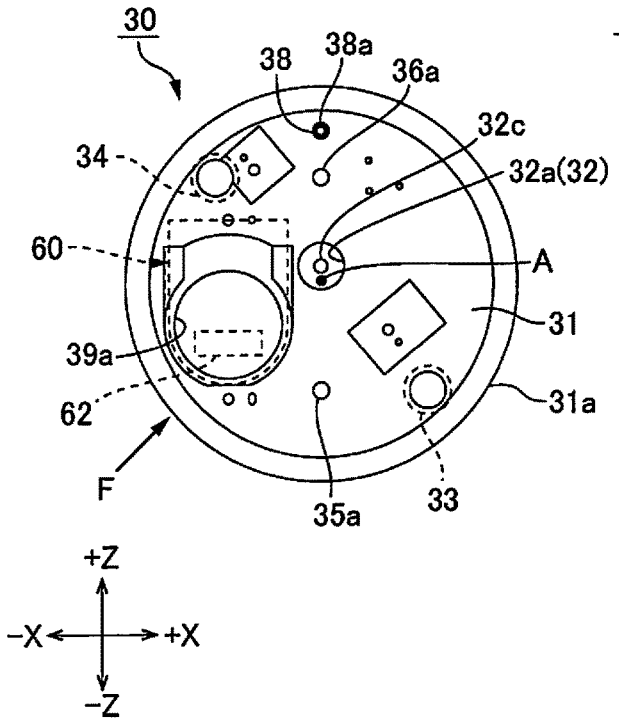
FIG. 5A is a front surface diagram of a cover.
Figure 5C:
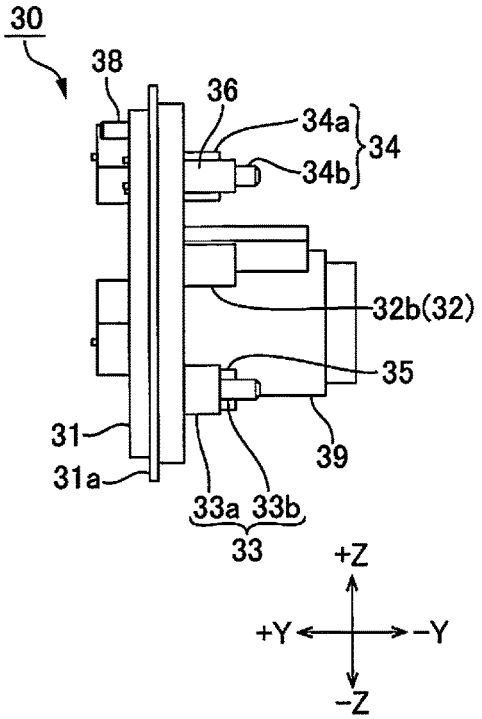
Figure 6:
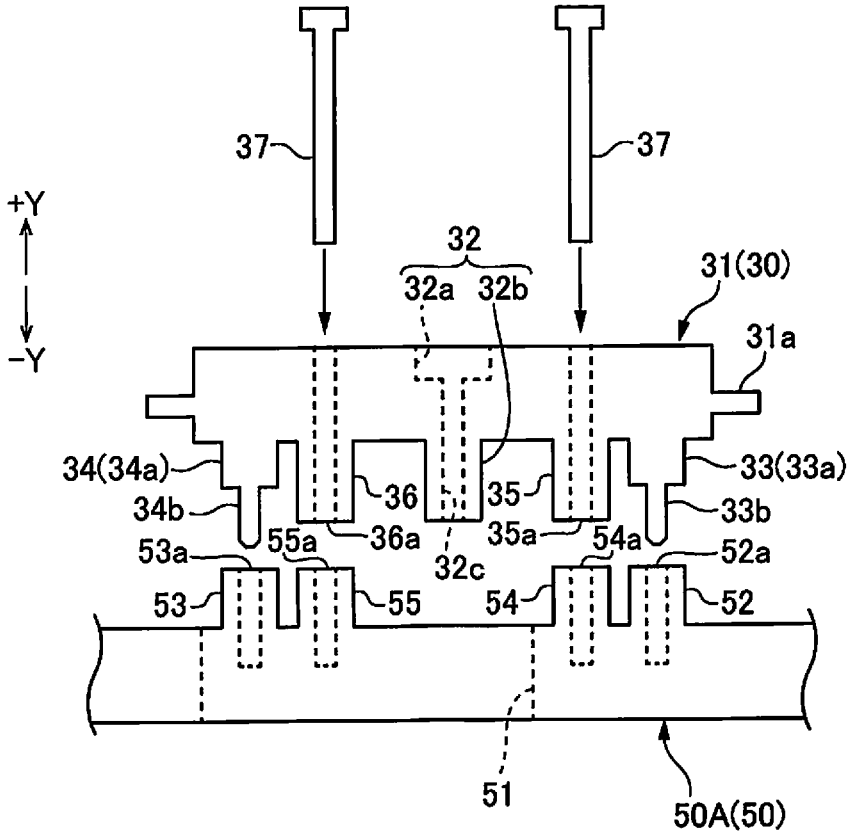
FIG. 6 is an explanatory diagram schematically illustrating a structure for fixing a cover and a mounting member.

FIG. 5A is a front surface diagram of the cover 30, and FIG. 5B, and FIG. 5C are side surface diagrams of the cover 30, FIG. 5A is a front surface diagram viewed from the +Y direction side, FIG. 5B is a side surface diagram viewed from the +Z direction side, and FIG. 5C is a side surface diagram viewed from the +X direction side. In addition, FIG. 6 is an explanatory diagram schematically illustrating a structure for fixing the cover 30 and the mounting member 50 (a diagram viewed from the direction of an arrow F in FIG. 5A) and illustrates a state where the mounting member 50 and the cover 30 are separated in the container forward and backward direction Y.

The cover 30 is mounted in a state of being able to rotate with regard to the circular opening 41 of the blow tank 40 with the central axis line of the cylindrical section 42 as the center. An ink supply section 32 (a liquid supply section) is provided in the cover 30 at a position which is slightly deviated from a center of rotation A (refer to FIG. 5A). The ink supply section 32 is provided with a connection port 32*a* which is an opening in a surface of the cover body section 31 on the +Y direction side and a protruding section 32*b* which protrudes in the −Y direction from a position on the rear side of the connection port 32*a* in the cover body section 31. The supply tube 16, which configures an ink flow path with the intermediate tank 14, is connected with the connection port 32*a*. An ink supply needle (which is omitted from the drawings) is provided at the tip end of the protruding section 32*b*, and the ink flow path 32*c*, which links the connection port 32*a* and the ink supply needle, is formed at an inner section of the protruding section 32*b*.

On the other hand, the mounting member 50 is provided with a mounting member body section 50A with a substantially rectangular shape which is long in the container width direction X, and end plate sections 50B and 50C which are provided at either end of the mounting member body section 50A in the container width direction X. A through hole section 51 is formed in the mounting member body section 50A in a region which overlaps with the ink supply section 32 in the container forward and backward direction Y. The through hole section 51 passes through the mounting member body section 50A in the container forward and backward direction Y. In the ink container containing section 22, the mounting member 50 is arranged inside the blow tank 40 on the circular opening 41 side, and the cover 30 is arranged outside the blow tank 40 on the circular opening 41 side. That is, the mounting member 50 and the cover 30 are arranged so as to interpose the cylindrical section 42 of the blow tank 40 and are fixed using the structure for fixing which will be described below. At this time, the ink supply needle of the ink supply section 32 is flush with the through hole section 51 and opposes the ink container 23 which is mounted on the rear surface side of the mounting member body section 50A.

(Structure for Fixing Cover and Mounting Member)

As shown in FIG. 5A, positional alignment protrusions 33 and 34 (a cover engaging section) which protrude to the −Y direction side are formed in the cover body section 31 at two locations which are point symmetrical with the center of rotation A as a reference. That is, the positional alignment protrusions 33 and 34 are formed at positions which are closer to the outer edge of the cover 30 than the center of rotation A. The base end section of the positional alignment protrusion 33 is a large diameter section 33*a* with a circular column shape, and the tip end section of the positional alignment protrusion 33 is a small diameter section 33*b* with a circular column shape which has a smaller diameter than the large diameter section 33*a*. A taper section, where the diameter is reduced in accompaniment with heading toward the tip end side, is formed at the tip end of the small diameter section 33*b*. The positional alignment protrusion 34 has the same shape as the positional alignment protrusion 33 and is provided with a large diameter section 34*a* and a small diameter section 34*b*. On the other hand, circular column protruding sections 52 and 53 (refer to FIG. 4 and FIG. 6) are formed in the mounting member body section 50A at positions which overlap with the positional alignment protrusions 33 and 34 in the container forward and backward direction Y. The circular column protruding sections 52 and 53 protrude from the mounting member body section 50A in the +Y direction. Positional alignment holes 52*a* and 53*a* (mounting member positional alignment sections) are openings in end surfaces of the circular column protruding sections 52 and 53 on the +Y direction side. The positional alignment holes 52*a* and 53*a* are concave sections which do not pass through the mounting member body section 50A, and the depth of the positional alignment holes 52*a* and 53*a* is deeper than the length of the small diameter sections 33*b* and 34*b*.

In addition, boss sections 35 and 36 are formed in the cover body section 31 at two locations, which are different to the positions of the positional alignment protrusions 33 and 34 in the circumferential direction, at positions which are away from the center of rotation A. The boss sections 35 and 36 are arranged at two locations which are point symmetrical with the center of rotation A as a reference and protrude from the cover body section 31 in the −Y direction. Fixing holes 35*a* and 36*a*, which pass through the cover body section 31 and the boss sections 35 and 36 in the container forward and backward direction Y, are formed in the cover 30. The fixing holes 35*a* and 36*a* are arranged at positions which are closer to the center of rotation A of the cover 30 than the positional alignment protrusions 33 and 34. On the other hand, boss sections 54 and 55 are formed in the mounting member body section 50A at positions which overlap with the fixing holes 35*a* and 36*a* in the container forward and backward direction Y. Fixing holes 54*a* and 55*a* are openings in the end surfaces of the boss sections 54 and 55 on the +Y direction side. The fixing holes 54*a* and 55*a* are concave sections which do not pass through the mounting member body section 50A.

As described above, the cover 30 and the mounting member 50 are fixed with screws so as to interpose the cylindrical section 42, which is provided at the opening edge of the circular opening 41 in the blow tank 40, from the both sides in the container forward and backward direction Y. As shown in FIG. 6, first, the small diameter sections 33*b* and 34*b* of the positional alignment protrusions 33 and 34 which protrude from the cover 30 and the positional alignment holes 52*a* and 53*a* of the circular column protruding sections 52 and 53 which protrude from the mounting member 50 are opposed in the container forward and backward direction Y during fixing. Then, the mounting member 50 and the cover 30 approach each other in the container forward and backward direction Y, and the small diameter section 33*b* is inserted into the positional alignment hole 52*a* and the small diameter section 34*b* is inserted into the positional alignment hole 53*a*. At this time, inserting of the small diameter sections 33*b* and 34*b* is guided by the taper section which is at the tip end. Then, the mounting member 50 is positionally aligned with regard to the cover 30 in the container forward and backward direction Y due to the tip end surfaces of the boss sections 54 and 55 abutting with the tip end surfaces of the boss sections 35 and 36.

The mounting member 50 and the cover 30 are positionally aligned by the positional alignment protrusions 33 and 34 engaging with the positional alignment holes 52*a* and 53*a*. Out of the engaging sections at the two locations, one is an engaging section which sets a reference position and the other is an engaging section for stopping rotation where a relative rotation position where the reference position is the center is set. When the mounting member 50 is positionally aligned with regard to the cover 30, the fixing holes 35*a* and 36*a* on the cover 30 side and the fixed holes 54*a* and 55*a* at the mounting member body section 50A side overlap in the container forward and backward direction Y. In this state, fixing screws 37 are attached to each of the fixing holes 35*a* and 36*a* from the outer side of the tank (the +Y direction side), and the tip ends of the fixing screws 37 are screwed into the fixed holes 54*a* and 55*a* until locked. Due to this, the mounting member 50 is fixed by screws with regard to the cover 30.

(Pressurizing Hole)

As shown in FIG. 2 to FIGS. 5A to 5C, a pressurizing tube connecting section 38 which protrudes in the +Y direction is formed in the cover 30 at a position which is closer to the outer edge of the cover 30 than the center of rotation A, in more detail, on an outer side of the fixing hole 35*a* in the radial direction. A pressurizing hole 38*a* (refer to FIGS. 5A to 5C) is an opening in the tip end of the pressurizing tube connecting section 38. The pressurizing hole 38*a* passes through the pressurizing tube connecting section 38 and the cover body section 31 in the container forward and backward direction Y. The pressurizing tube 3, which extends from the pressurizing section 2 which is arranged in the vicinity of the cover 30, is connected with the pressurizing tube connecting section 38. Pressurized air (pressurized fluid) from the pressurizing tube 3 flows into the pressurizing hole 38*a*. When the circular opening 41 and the rear side opening are sealed, the inner section of the ink container containing section 22 becomes a sealed space. Pressurized air is fed into the sealed space from the pressurizing hole 38*a* and the ink container containing section 22 is pressurized. As described above, since the fixed holes 54*a* and 55*a* and the positional alignment holes 52*a* and 53*a* which are used to fix the cover 30 and the mounting member 50 do not pass through the mounting member 50, the ink container containing section 22 becomes a section where only the two locations of the pressurizing hole 38*a* and the ink supply section 32 are linked with the outside.

(Terminal Arrangement Section)

As shown in FIGS. 5A to 5C, a terminal arrangement section 39 is provided in the cover 30 between the positional alignment protrusion 33 and the fixing hole 36*a*. The terminal arrangement section 39 is arranged at a position which is closer to the center of rotation A of the cover 30 than the pressurizing hole 38*a*. In addition, the ink supply section 32 is formed at a position which is even closer to the center of rotation A than the terminal arrangement section 39. The diameter (the inner diameter) of the ink flow path 32*c* (the liquid flow path) which is formed in the ink supply section 32 is larger than the diameter (the inner diameter) of the pressurizing hole 38*a*. The terminal arrangement section 39 protrudes from the cover body section 31 in the −Y direction. When the cover 30 and the mounting member 50 are fixed, the terminal arrangement section 39 is arranged in the through hole section 51 of the mounting member body section 50A and protrudes into the space in which the ink container 23 is arranged. The through hole section 39*a* which passes through in the container forward and backward direction Y is formed in the terminal arrangement section 39. One end of the through hole section 39*a* is an opening in the tip surface of the terminal arrangement section 39 (the end surface on the −Y direction side) and the other end of the through hole section 39*a* is an opening in the surface on the +Y direction side of the cover body section 31. A connector unit 60 is mounted in the through hole section 39*a*. In addition, a board holding section 82 (refer to FIG. 3 and FIG. 4) which is provided at the front end of the ink container 23 is inserted into the through hole section 39*a* in the +Y direction. As will be described later, a circuit board 83 (refer to FIG. 3 and FIG. 4) is provided in the board holding section 82 and a connection terminal 62 (refer to FIGS. 5A to 5C and FIG. 9) which is connected to the circuit board 83 is provided in the connector unit 60. Since the connection terminal 62 is arranged in the through hole section 39*a* of the terminal arrangement section 39, the connection terminal 62 is closer to the center of rotation A of the cover 30 than the pressurizing hole 38*a* and is separated from the center of rotation A more than the ink supply section 32.

(Ink Container)

Figure 7:
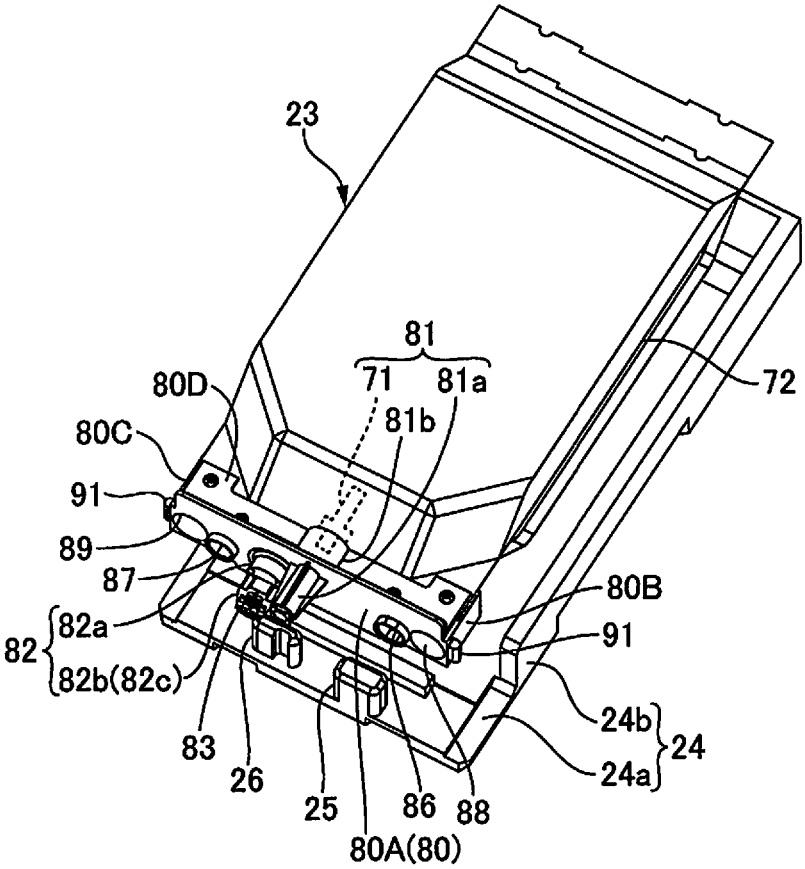
FIG. 7 is a perspective diagram illustrating a state where an ink container is lifted up from a tray.
Figure 8A:
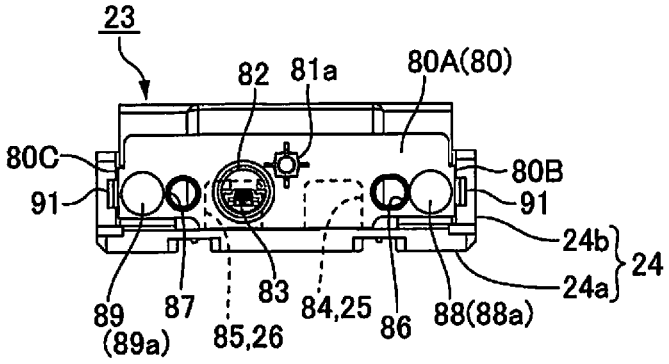
FIGS. 8A and 8B are front surface diagrams of an ink container and a tray.
Figure 8B:
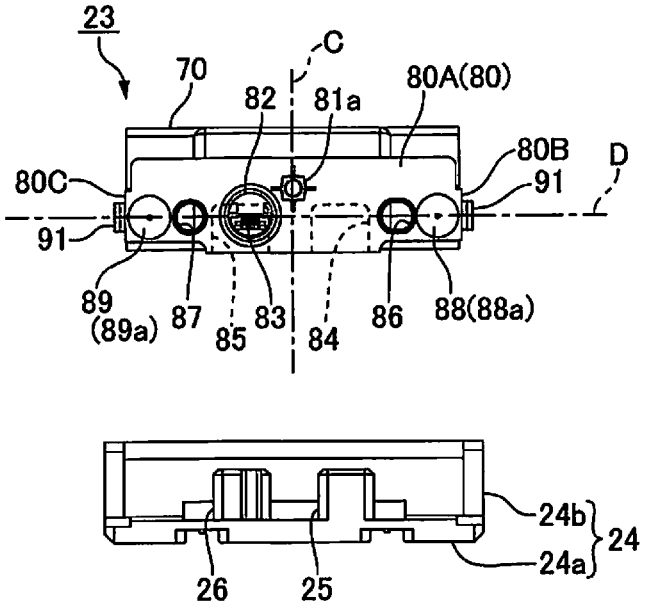

FIG. 7 is a perspective diagram illustrating a state where the ink container 23 is lifted up from a tray 24. In addition, FIGS. 8A and 8B are front surface diagrams of the ink container 23 and the tray 24. FIG. 8A illustrates a state where the ink container 23 is loaded on the tray 24 and FIG. 8B illustrates a state where the ink container 23 is lifted up from the tray 24. The ink container 23 is provided with an ink pack 70 (a liquid containing body) which is long in the container forward and backward direction Y and an adapter 80 which is attached to one end of the ink pack 70 in the longitudinal direction. Moving the ink container 23 in and out of the ink container containing section 22 is performed in a state where the ink container 23 is loaded on the tray 24.

(Ink Pack)

The ink pack 70 is a liquid containing bag which is flexible and encloses ink in an inner section. The planar shape of the ink pack 70 is substantially rectangular and has a size which fits into the tray 24. A linking section 71 (refer to FIG. 7), which links the inside and the outside of the ink pack 70, is formed at an end section of the ink pack 70 on the +Y direction side. The ink pack 70 is in a sealed state except for the linking section 71. The linking section 71 is configured by attaching a component with a pipe shape to an edge of a bag body which is flexible. Gusset sections 72 are formed at side surfaces of the ink pack 70 on the +X direction side and the −X direction side. The gusset sections 72 extend in the container up and down direction Z when the full amount of ink in the ink pack 70 is large, and the capacity of the ink pack 70 is large. When the amount of ink is reduced due to ink being fed from the ink pack 70, the ink pack 70 is thin due to the gusset sections 72 being folded, and the capacity of the ink pack 70 is small.

(Adapter)

The ink container 23 is inserted from the rear side opening in the ink container containing section 22 in a mounting direction B (the +Y direction in the present embodiment) in a state of being loaded on the tray 24 with the adapter 80 in the front. The adapter 80 is provided with a front plate section 80A which is long in the container width direction X, end plate sections 80B and 80C which are provided on either end of the front plate section 80A in the container width direction X, and an ink pack attachment section 80D (an attachment section) which is provided on the rear surface side (on the −Y direction side) of the front plate section 80A. The ink pack attachment section 80D is fixed so as to interpose an end edge on the +Y direction side of the ink pack 70. The end plate sections 80B and 80C extend from both ends of the front plate section 80A in the −Y direction.

(Ink Leading Section)

The front plate section 80A is provided with an adapter front end surface with a substantially rectangular shape which faces the +Y direction. A protruding section 81*a* which protrudes in the +Y direction is formed at the center of the front plate section 80A in the container width direction X. In addition, a raised section 81*b*, which is formed on an upper surface (a surface in the +Z direction) of the ink pack attachment section 80D, extends from the rear side (the −Y direction side) of the protruding section 81*a* in the container forward and backward direction Y. An ink flow path, which passes through the protruding section 81*a* and the raised section 81*b* in the container forward and backward direction Y, is provided in the adapter 80, and one end of the ink flow path is an opening in the tip end surface of the protruding section 81*a*. The linking section 71 of the ink pack 70 is connected with the other end of the ink flow path. An ink leading section 81 which leads ink from the ink pack 70 is configured using the protruding section 81*a*, the raised section 81*b*, and the linking section 71. When the ink container 23 is mounted in the ink container containing section 22, the ink leading section 81 is connected with the ink supply section 32 of the cover 30. Accordingly, ink which is fed from the ink leading section 81 is supplied to the intermediate tank 14 through the ink supply section 32 and the supply tube 16. At this time, when the ink container containing section 22 is pressurized, feeding of ink into the inner section is promoted by the ink pack 70 being flattened due to air pressure.

(Structure for Fitting of Ink Container and Tray)

As shown in FIG. 7 and FIGS. 8A and 8B, the tray 24 where the ink container 23 is loaded is provided with a bottom plate section 24*a* with a rectangular shape which is long in the container forward and backward direction Y and a side wall section 24*b* which protrudes in the +Z direction along the end edges in three directions of the +X direction side, the −Y direction side, and the −X direction side of the bottom plate section 24*a*. A first fitting section 25 and a second fitting section 26 are provided in the tray 24 at an end edge of the bottom plate section 24*a* on the +Y direction side. The first fitting section 25 and the second fitting section 26 are protruding sections which protrude from the bottom plate section 24*a* in the +Z direction and are arranged so as to be separated in the container width direction X.

The ink container 23 is arranged such that the adapter 80 is loaded on the end edge of the tray 24 on the +Y direction side. As shown in FIGS. 8A and 8B, when the adapter 80 is arranged at the front end of the tray 24, a first fitted section 84 is formed in the front plate section 80A of the adapter 80 at a position which overlaps with the first fitting section 25 in the container up and down direction Z, and a second fitted section 85 is formed in the front plate section 80A of the adapter 80 at a position which overlaps with the second fitting section 26 in the container up and down direction Z. The first fitted section 84 and the second fitted section 85 are convex sections which are both openings in the −Z direction. When the ink container 23 is loaded on the tray 24, the first fitting section 25 and the first fitted section 84 fit together in the container up and down direction Z, and the second fitting section 26 and the second fitted section 85 fit together in the container up and down direction Z. Due to this, the ink container 23 is positionally aligned with regard to the tray 24 in the container width direction X and the container forward and backward direction Y.

(Connection of Circuit Board and Connection Terminal)

As shown in FIG. 3, FIG. 4, FIG. 7, and the like, the board holding section 82, which protrudes in the +Y direction, is formed in the front plate section 80A on the −X direction side of the protruding section 81*a*. The board holding section 82 is provided with a base end section 82*a* with a substantially circular column shape and a board attachment section 82*b* which protrudes even further from the tip end surface of the base end section 82*a* in the +Y direction. An inclined surface 82*c* is formed at the tip end of the board attachment section 82*b*. The inclined surface 82*c* is a surface where an XZ plane is inclined in a direction of inclination so as to move in the +Y direction in accompaniment with heading toward the −Z direction. An O-ring (which is omitted from the drawings) is mounted on the outer circumference at the base of the base end section 82*a*. When the ink container 23 is mounted in the ink container containing section 22, the board holding section 82 is inserted into the through hole section 39*a* (refer to FIG. 5A) of the terminal arrangement section 39 which protrudes to the rear side of the cover 30. The board holding section 82 opposes the connector unit 60 (refer to FIG. 4 and FIGS. 5A to 5C), which is mounted in the through hole section 39*a* from the +Y direction, in the container forward and backward direction Y.

Figure 9A:
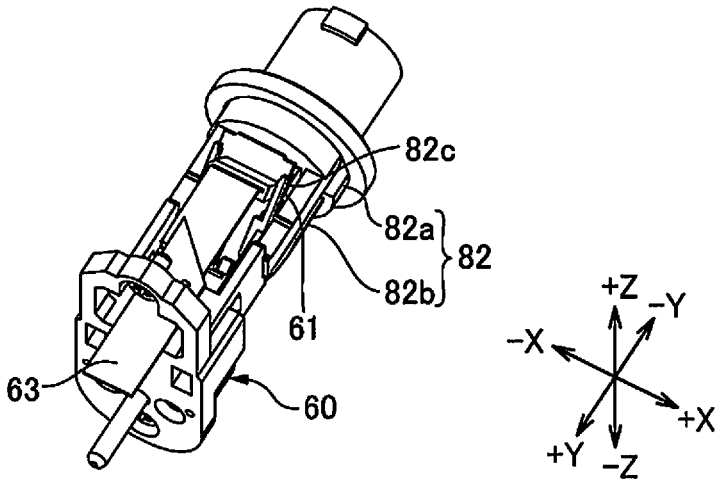
FIGS. 9A and 9C are perspective diagrams illustrating a connector unit and a board holding member.
Figure 9B:
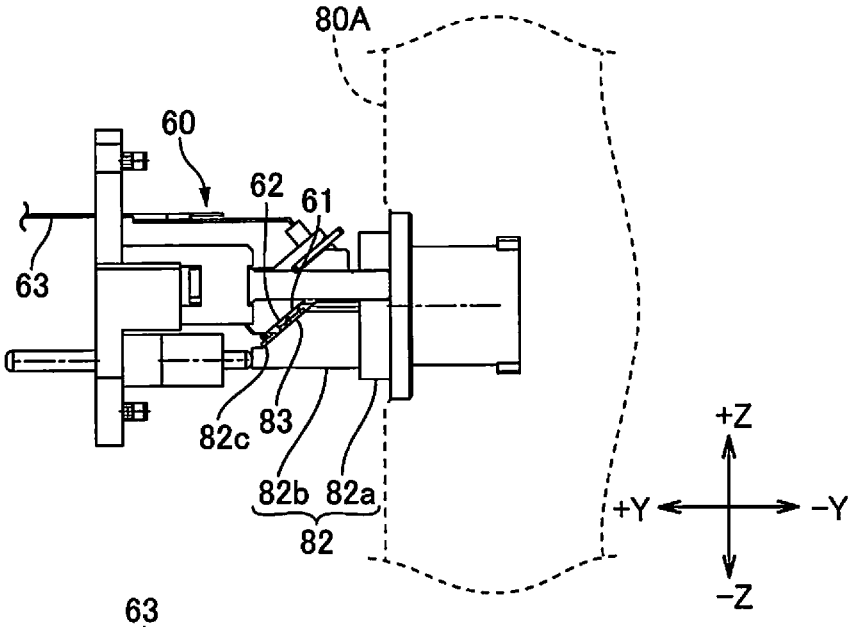
FIG. 9B is a side surface diagram illustrating a connector unit and a board holding member.
Figure 9C:
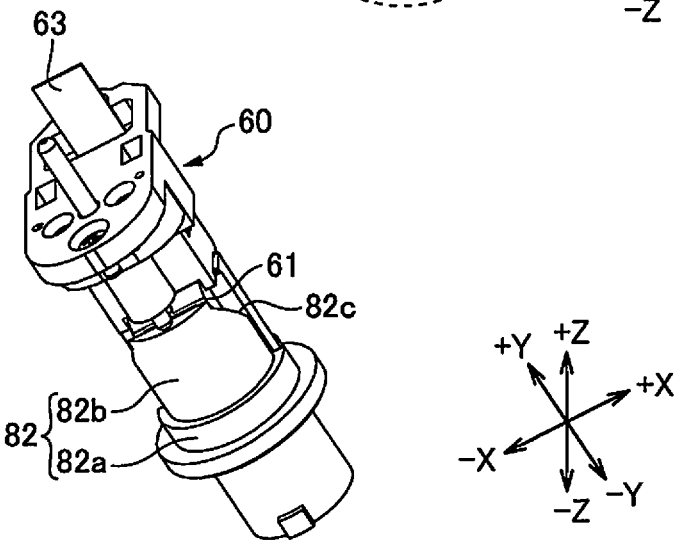

FIGS. 9A and 9C are perspective diagrams illustrating the connector unit 60 and the board holding member 82, FIG. 9B is a side surface diagram illustrating the connector unit 60 and the board holding member 82, FIGS. 9A and 9C are perspective diagrams viewed from the +Y direction side, and FIG. 9B is a side surface diagram viewed from the +X direction side. The board holding section 82 is formed by a separate component being mounted in a mounting hole which is formed in the front plate section 80A of the adapter 80. Here, the board holding section 82 may be integrally formed with the front plate section 80A. The circuit board 83 is attached to the inclined surface 82*c* of the board holding section 82. The circuit board 83 is a circuit board which is provided with a memory element which stores the amount of ink which is inside the ink container 23 and the like. An inclined surface 61 which opposes the inclined surface 82*c* of the board holding section 82 is provided in the connector unit 60. The inclined surface 61 is a surface which is parallel to the inclined surface 82*c* and is arranged inside the through hole section 39*a* when the connector unit 60 is mounted in the terminal arrangement section 39 of the cover 30. The connection terminal 62 is arranged on the inclined surface 61. A wiring 63 which conducts with the connection terminal 62 is drawn around to the rear surface side of the inclined surface 61. The wiring 63 is drawn out from the connector unit 60 to the front surface side of the cover 30 and is drawn around to the printer body section 10 side along with the supply tube 16 which is for supplying of ink.

While the ink container 23 is mounted in the ink container containing section 22, the board holding section 82 is inserted into the through hole section 39*a* of the cover 30 in accompaniment with the ink container 23 moving in the mounting direction B. The connection terminal 62, which is arranged at the inclined surface 61 of the connector unit 60, is connected with the circuit board 83 which is arranged on the inclined surface 82*c* of the adapter 80 as shown in FIGS. 9A to 9C when mounting of the ink container 23 in the ink container containing section 22 is completed.

(Positional Alignment of Ink Container and Mitigating Shocks Using Dampers)

A first guide hole 86 and a second guide hole 87 which are openings in the +Y direction are formed in the front plate section 80A of the adapter 80. The first guide hole 86 and the second guide hole 87 are arranged symmetrically in the container width direction X with the YZ plane (the YZ plane which includes the line C-C in FIG. 8B), which passes through the center of the tip end of the protruding section 81*a* of the ink leading section 81, as a reference. The first guide hole 86 is arranged on the +X direction side with regard to the protruding section 81*a* and the second guide hole 87 is arranged on the −X direction side with regard to the protruding section 81*a*. The first guide hole 86 and the second guide hole 87 pass through the front plate section 80A in the container forward and backward direction Y. The first guide hole 86 is a long hole which is long and narrow in the container width direction X. On the other hand, the second guide hole 87 is a hole which is a perfect circle.

In addition, a first concave section 88 is formed in the front plate section 80A of the adapter 80 further to the +X direction side with regard to the first guide hole 86 and a second concave section 89 is formed in the front plate section 80A of the adapter 80 further to the −X direction side with regard to the second guide hole 87. The first concave section 88 and the second concave section 89 are concave sections which are recessed in the −Y direction. The first concave section 88 and the second concave section 89 are arranged symmetrically in the container width direction X with the line C-C as a reference and are arranged equal distances from the protruding section 81*a* of the ink leading section 81. The first concave section 88, the first guide hole 86, the second guide hole 87, and the second concave section 89 are arranged on the front end surface of the adapter in a straight line which is parallel with the container width direction X. The ink leading section 81 is arranged more to the upper side (the +Z direction side) of the container than the arrangement positions of the first concave section 88, the first guide hole 86, the second guide hole 87, and the second concave section 89. In addition, a straight line D which passes through the center of a bottom surface 88*a* of the first concave section 88 and the center of a bottom surface 89*a* of the second concave section 89 overlaps with first and second fitted sections 84 and 85 (refer to FIGS. 8A and 8B), which are parts for fitting the first and second fitting sections 25 and 26 of the tray 24, in the adapter 80.

On the other hand, two guide pins 56 and 57, which protrude from the mounting member body section 50A in the −Y direction, are provided in the mounting member 50. The guide pin 56 is arranged on the +X direction side with regard to the through hole section 51 and the guide pin 57 is arranged on the −X direction side with regard to the through hole section 51. In addition, dampers 58 and 59 are arranged on the outer side with regard to the guide pins 56 and 57 in the container width direction X. The damper 58 is arranged on the +X direction side with regard to the guide pin 56 and the damper 59 is arranged on the −X direction side with regard to the guide pin 57. Tip end sections of the dampers 58 and 59 protrude from the mounting member body section 50A in the −Y direction. The damper 58, the guide pin 56, the guide pin 57, and the damper 59 are arranged on a straight line which is parallel with the container width direction X.

The ink container 23 is inserted into the ink container containing section 22 with the adapter 80 which is arranged at the front opposing the mounting member 50 in the container forward and backward direction Y. At this time, the guide pin 56 of the mounting member 50 opposes the first guide hole 86 of the adapter 80 and the guide pin 57 of the mounting member 50 opposes the second guide hole 87 of the adapter 80. In addition, the damper 58 of the mounting member 50 opposes the first concave section 88 of the adapter 80 and the damper 59 of the mounting member 50 opposes the second concave section 89 of the adapter 80. When the ink container 23 is moved in the mounting direction B (that is, in the +Y direction), the adapter 80 which is arranged in the front gets closer to the mounting member 50. At this time, first, inserting of the dampers 58 and 59 into the first and second concave sections 88 and 89 is started. Next, inserting of the guide pins 56 and 57 into the first and second guide holes 86 and 87 starts before the tip ends of the dampers 58 and 59 come into contact with the bottom surfaces 88*a* and 89*a* of the first and second concave sections 88 and 89.

The guide pins 56 and 57 are inserted into the first and second guide holes 86 and 87 while being guided by the taper sections which are formed in the tip ends of the guide pin 56 and 57. Except for the tapered sections, the diameters of the guide pins 56 and 57 are constant circular column shapes. When portions with the circular column shapes in the guide pins 56 and 57 are inserted into the first and second guide holes 86 and 87, the adapter 80 is positionally aligned on the XZ plane with regard to the mounting member 50. At this time, the second guide hole 87 is a reference for positional alignment since the second guide hole 87 is a perfect circle. On the other hand, rotation of the adapter 80 with regard to the mounting member 50 is stopped since the first guide hole 86 is a long hole. After positional alignment on the XZ plane using the guide pins 56 and 57 and the first and second guide holes 86 and 87 is completed, the tip ends of the dampers 58 and 59 abut with the bottom surfaces 88*a* and 89*a* of the first and second concave sections 88 and 89 (refer to FIGS. 8A and 8B).

The dampers 58 and 59 are air dampers which are able to expand and contract in the container forward and backward direction Y. The dampers 58 and 59 are provided with a concave section space (which is omitted from the drawings), which is formed in the protruding sections 58*a* and 59*a* which protrude from the mounting member body section 50A in the −Y direction, and pistons 58*b* and 59*b* which seal one end of the concave space. The concave section space extends in the container forward and backward direction Y, and the pistons 58*b* and 59*b* are able to move in the +Y direction, in which air in the concave section space is compressed, and the opposite direction to the +Y direction. A coil spring (which is omitted from the drawings) is arranged between the bottom section of the concave section space and the pistons 58*b* and 59*b*.

After the tip end surfaces of the pistons 58*b* and 59*b* abut with the bottom surfaces 88*a* and 89*a* of the first and second concave sections 88 and 89, the dampers 58 and 59 press and move the pistons 58*b* and 59*b* in the +Y direction in accompaniment with the ink container 23 moving further in the mounting direction B (that is, in the +Y direction). At this time, since the pistons 58*b* and 59*b* compress air in the concave section space, a buffering force, which resists the force of inertia of the ink container 23 which moves in the mounting direction B, is generated in the dampers 58 and 59. Accordingly, after the dampers 58 and 59 abut with the bottom surfaces 88*a* and 89*a* of the first and second concave sections 88 and 89, the force of shocks, which act on the protruding parts of the ink container containing section 22 and the ink container 23, is reduced using the buffering action of the dampers 58 and 59.

As described above, the ink container 23 is provided with the ink leading section 81 which protrudes from the adapter 80 in the +Y direction. On the other hand, the ink supply section 32, which protrudes from the protruding section 51 of the mounting member 50 to the ink container 23 side, is provided in the ink container containing section 22. When positional alignment of the adapter 80 on the XZ plane is carried out with regard to the mounting member 50 using the guide pins 56 and 57, the ink leading section 81 of the ink container 23 opposes the ink supply section 32 of the ink container containing section 22. After a state is reached where buffering action acts due to the dampers 58 and 59 starting to compress, the ink leading section 81 is connected with the ink supply section 32. A sealing member (which is omitted from the drawings), which is pushed in the +Y direction by a spring seat, is provided at the tip end section of the ink leading section 81. When the ink leading section 81 is not connected with the ink supply section 32, the sealing member stops ink from flowing out by blocking off the ink leading section 81. When the ink leading section 81 is connected with the ink supply section 32, the sealing member is pressed and moved in the −Y direction by the ink supply needle, and as a result, the flow path inside the ink leading section 81 and the flow path inside the ink supply section 32 are linked.

After the ink supply section 32 and the ink leading section 81 are connected, the ink container 23 moves further in the mounting direction B (the +Y direction). At this stage, connecting of the connection terminal 62, which is held in the cover 30 of the ink container containing section 22, and the circuit board 83, which is held in the adapter 80 of the ink container 23, is performed. That is, when the ink supply section 32 and the ink leading section 81 are connected, the board holding section 82 which holds the circuit board 83 is already inserted in the tip end side of the through hole section 39*a* where the connector unit 60 is attached. When the ink container 23 moves further in the mounting direction B from this state, first, the O-ring (which is omitted from the drawings), which is mounted in the base end section 82*a* of the board holding section 82, is flattened by the tip end surface of the terminal arrangement section 39. Due to this, the through hole section 39*a* is no longer linked with the pressurized space inside the ink container containing section 22 and it is possible to perform connecting of the circuit board 83 and the connection terminal 62 outside of the pressurized space. Next, the connection terminal 62, which is attached to the inclined surface 61 of the connector unit 60, and the circuit board 83, which is attached to the inclined surface 82*c* of the board attachment section 82*b*, come into contact inside the through hole section 39*a*. During contact, the circuit board 83 and the connection terminal 62 are in sliding contact along the inclination direction of the inclined surfaces 61 and 82*c*.

As above, the ink container 23 is mounted in the ink container containing section 22 through the five steps of (1) to (5) below.

(1) Positionally aligning the tray 24 and the ink container 23 using the fitting sections at two locations (2) Positionally aligning of the mounting member 50 and the ink container 23 using the two guide pins 56 and 57

(3) Generating buffering action using the dampers 58 and 59

(4) Connecting the ink supply section 32 and the ink leading section 81

(5) Contacting of the connection terminal 62 on the ink container containing section 22 side and the circuit board 83 on the ink container 23 side (Structure for Preventing Extraction of Ink Container)

When the ink container 23 is mounted in the ink container containing section 22, the end plate section 80B of the adapter 80 is positioned on the inner side of the end plate section 50B of the mounting member 50 in the container width direction X, and the end plate section 80C is positioned on the inner side of the end plate section 50C of the mounting member 50 in the container width direction X. Plate springs 90 are attached to the inner side surfaces of the end plate sections 50B and 50C in the container width direction X. On the other hand, locking sections 91, which are protruding sections which protrude from the outer side surfaces in the container width direction X, are formed in the end plate sections 80B and 80C. When the ink container 23 moves in the mounting direction B inside the ink container containing section 22, the plate springs 90 and the locking sections 91 engage at two locations between the end plate section 50B and the end plate section 80B and between the end plate section 50C and the end plate section 80C. When the five steps of (1) to (5) described above are completed, engaging of the plate springs 90 and the locking sections 91 at both end sections of the ink container 23 in the container width direction X is also completed. Engaging is not released due to weak vibration at the locations where the plate springs 90 and the locking sections 91 are engaged. Accordingly, engaging of the plate springs 90 and the locking sections 91 functions to prevent extraction for the ink container 23 when there is vibration. On the other hand, a user easily releases engaging at the engaging locations using a force to the extent of pulling the ink container 23. Accordingly, replacement of the ink container 23 is easy.

(Actions and Effects)

As above, the printer 1 of the present embodiment is provided with the main tank 21 which retains ink which is supplied to the ink jet head 11, the ink container containing section 22 of the main tank 21 has the blow tank 40 which contains the ink container 23, the mounting member 50 where the ink container 23 is attached and detached, and the cover 30 which covers the circular opening 41 which is formed in the blow tank 40. The mounting member 50 is arranged inside the blow tank 40 on the circular opening 41 side, and the mounting member 50 and the cover 30 are fixed with screws. In this manner, in a case where the cover 30 is fixed to the mounting member 50 which is arranged inside the blow tank 40, it is not possible to move the cover 30 in the +Y direction since the mounting member 50 is not extracted from the circular opening 41 even when the cover moves to separate from the circular opening 41. Accordingly, the concern that the cover 30 may be loosened is reduced and positional deviation of the cover 30 is suppressed even in a case where the inside of the blow tank 40 is pressurized. As such, it is possible to suppress defects which are caused by positional deviation of the cover 30 (for example, connection faults at the ink supply section 32, the pressurizing hole 38*a*, the connection terminal 62, and the like which are provided in the cover 30).

In addition, in the present embodiment, the mounting member 50 and the cover 30 are positionally aligned by the mounting member 50 having the positional alignment holes 52*a* and 53*a*, the cover 30 having the positional alignment protrusions 33 and 34, and the positional alignment protrusions 33 and 34 engaging with the positional alignment holes 52*a* and 53*a*. In this manner, it is possible to suppress positional deviation of the cover 30 by fixing the mounting member 50 and the cover 30 in a state being positionally aligned. Then, since the adapter 80, which is provided on the front end of the ink container 23 inside the blow tank 40, is mounted on the mounting member 50, it is possible to suppress connection faults between a configuration component on the cover 30 side and a configuration component on the ink container 23 side by suppressing positional deviation of the cover 30 with regard to the mounting member 50. For example, it is possible to suppress connection faults between the ink leading section 81 of the ink container 23 and the ink supply section 32 of the cover 30. In addition, it is possible to suppress connection faults between the circuit board 83 of the ink container 23 and the connection terminal 62 of the cover 30.

Additionally, in the present embodiment, the fixing holes 35*a* and 36*a*, which fix the cover 30 to the mounting member 50, are arranged at positions which are closer to the center of rotation A of the cover 30 than the positional alignment protrusions 33 and 34. Accordingly, when the cover 30 is positionally aligned with the mounting member 50 by the positional alignment protrusions 33 and 34, the amount of positional deviation of the fixing holes 35*a* and 36*a* is smaller than the dimensional error of at least the positional alignment protrusions 33 and 34 and the positional alignment holes 52*a* and 53*a*. Accordingly, it is possible to precisely fix the cover 30 to the mounting member 50. As such, assembly precision of the ink container containing section 22 is improved.

In addition, in the present embodiment, the positional alignment protrusions 33 and 34 of the cover 30 are formed at positions which are closer to the outer edge of the cover 30 than the center of rotation A of the cover 30. Accordingly, when the cover 30 moves to rotate with the center of rotation A as the center, considerable resistance acts on the engaging section of the positional alignment protrusions 33 and 34 and the positional alignment holes 52*a* and 53*a*. Accordingly, it is possible to strongly suppress positional deviation of the cover 30 and the mounting member 50. In addition, the positional alignment protrusions 33 and 34 are provided at two locations which are point symmetrical with the center of rotation A of the cover 30 as a reference. Accordingly, the resistance which opposes the rotation of the cover 30 acts at both sides which interpose the center of rotation A and the resistance is doubled. Accordingly, it is possible to more strongly suppress positional deviation of the cover 30 and the mounting member 50.

Furthermore, in the present embodiment, the ink supply section 32 is arranged at a position which is close to the center of rotation A of the cover 30, the pressurizing hole 38*a* is arranged at a position which is closer to the outer edge than the center of rotation A of the cover 30, and the terminal arrangement section 39 is arranged at a position which is closer to the center of rotation A than the pressurizing hole 38*a* and is further from the center of rotation A than the ink supply section 32. The connector unit 60, which is provided with the connection terminal 62, is mounted in the terminal arrangement section 39. Due to this, the liquid supply section 32 and the connection terminal 62 are arranged at a position where the amount of positional deviation is small in a case where the cover 30 is rotated. Accordingly, it is possible to suppress leaking of ink and terminal contact faults. In addition, the ink supply section 32 is arranged at the center of the mounting member 50 in the width direction (the container width direction X) even closer to the center of rotation A than the connection terminal 62. That is, the ink supply section 32 is arranged at a position where it is possible to connect with the ink leading section 81 which is formed at the center of the ink container 23 in the width direction (the container width direction X). Accordingly, it is possible to increase the capacity of the ink container 23 which uses the ink pack 70 in a bag form. Furthermore, it is advantageous in that, even if it is assumed that ink leaks from the ink supply section 32, there is little concern that ink which leaks flows into the pressurizing hole 38*a* since the pressurizing hole 38*a* is separated from the ink supply section 32.

In addition, in the present embodiment, the diameter (the inner diameter) of the ink flow path 32*c* in the ink supply section 32 is larger than the diameter (the inner diameter) of the pressurizing hole 38*a*. In this manner, in a case where the diameter of the ink flow path 32*c* is large, it is possible for the amount of ink flow to be large since there is little pressure loss in the ink flow path. Accordingly, it is possible to stably supply ink to the ink jet head 11. In addition, it is possible to reduce the concern that pressurized air will leak from the pressurizing hole 38*a* due to the diameter (the inner diameter) of the pressurizing hole 38*a* being small.

Here, the positions of the ink supply section 32, the positional alignment protrusions 33 and 34, the fixing holes 35*a* and 36*a*, the pressurizing hole 38*a*, and the terminal arrangement section 39 in the cover 30 are not limited to the positions which are shown in FIGS. 5A to 5C, and appropriate modifications are possible in the scope which satisfies the positional relationships described above (the ink supply section 32 is arranged at a position which is close to the center of rotation A of the cover 30, the pressurizing hole 38*a* is arranged at a position which is closer to the outer edge than the center of rotation A of the cover 30, the terminal arrangement section 39 is arranged at a position which is closer to the center of rotation A than the pressurizing hole 38*a* and is further from the center of rotation A than the ink supply section 32, and the fixing holes 35*a* and 36*a* are arranged at positions which are closer to the center of rotation A of the cover 30 than the positional alignment protrusions 33 and 34).

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid ejecting apparatus comprising:

a liquid container containing section; and a pressurizing section that pressurizes inside of the liquid container containing section, wherein the liquid container containing section has a casing that contains a liquid container, a mounting member that is mounted with the liquid container, and a cover that covers an opening that is formed in the casing, the mounting member is arranged inside the casing on the opening side, the cover is arranged outside the casing on the opening side, the mounting member is fixed to the cover, the casing includes a cylindrical section formed at an edge of the opening of the casing, the mounting member and the cover are arranged such that the cylindrical section is interposed between the mounting member and the cover, the cover further has a fixing hole that fixes the cover to the mounting member, and the fixing hole is arranged at a position that is closer to a center of rotation of the cover than a cover engaging section.

2. The liquid ejecting apparatus according to claim 1, wherein the mounting member has a mounting member positional alignment section that positionally aligns the cover, the cover has a cover engaging section that is positionally aligned by the mounting member, and the cover engaging section is positionally aligned by engaging with the mounting member positional alignment section.

3. The liquid ejecting apparatus according to claim 2, wherein the cover is rotatably provided with regard to the opening, and the cover engaging section is formed at a position that is closer to an outer edge of the cover than a center of rotation of the cover.

4. The liquid ejecting apparatus according to claim 3, wherein the cover engaging section is provided at two locations that are point symmetrical with the center of rotation of the cover as a reference.

5. The liquid ejecting apparatus according to claim 1, further comprising:

a liquid ejecting section;

a connection terminal that connects with a circuit board that is provided in the liquid container;

a liquid supply section that supplies liquid from the liquid container to the liquid ejecting section; and a pressurizing hole into which a pressurized fluid flows from the pressurizing section, wherein the pressurizing hole is formed at a position that is closer to an outer edge of the cover than a center of rotation of the cover, the connection terminal and the liquid supply section are arranged at a position that is closer to the center of rotation of the cover than the pressurizing hole, and the liquid supply section is arranged at a position that is closer to the center of rotation of the cover than the connection terminal.

6. The liquid ejecting apparatus according to claim 5, wherein a diameter of a liquid flow path that is provided in the liquid supply section is larger than a diameter of the pressurizing hole.

7. The liquid ejecting apparatus according to claim 1, wherein the fixing hole passes through the cover, and the fixing hole is configured such that the cover is fixed to the mounting member by a screw.

8. The liquid ejecting apparatus according to claim 1, wherein an outer side ring is mounted on an outer circumferential side of the cylindrical section and the cover.

9. The liquid ejecting apparatus according to claim 1, wherein the cover further has a pressurizing hole configured such that a pressurized fluid flows from the pressurizing section into the pressuring hole.

10. The liquid ejecting apparatus according to claim 1, wherein the mounting member further has a damper.

11. The liquid ejecting apparatus according to claim 1, wherein the mounting member further has a guide pin.

12. The liquid ejecting apparatus according to claim 1, wherein the mounting member and the liquid container containing section are engaged with each other by a plate spring and a locking section.

* * * * *